United States Patent [19]

Davis et al.

[11] 4,022,050

[45] May 10, 1977

[54] METHOD OF MANUFACTURING A HEAT EXCHANGER STEEL

[75] Inventors: Billy J. Davis, East Peoria; Harry J. Dawson, Dunlap; Ervin E. Mangus, Brimfield; Kenneth J. Miller, Peoria, all of Ill.

[73] Assignee: Caterpillar Tractor Co., Peoria, Ill.

[22] Filed: Dec. 4, 1975

[21] Appl. No.: 637,495

[52] U.S. Cl. ..... 72/379; 113/118 R; 165/170

[51] Int. Cl.[2] ..... B21D 53/04

[58] Field of Search ..... 113/118 R, 118 D, 1 C; 29/157.3 R, 157.3 D; 165/165, 170; 72/379

[56] References Cited

UNITED STATES PATENTS 2,988,033 6/1961 Gapp ..... 113/118 R 3,119,446 1/1964 Weiss ..... 165/170

*Primary Examiner*—Lowell A. Larson

*Attorney, Agent, or Firm*—Charles E. Lanchantin, Jr.

[57] ABSTRACT

A method of making a heat exchanger sheet is disclosed including progressively forming an elongated flat sheet of metal into a continuously corrugated sheet having a plurality of deeply drawn convolutions which extend across the sheet, and compressing the periphery of the corrugated sheet to provide a substantially flattened edge portion while retaining a centrally disposed corrugated portion with minimal cold working thereof. Preferably, the sheet made thereby has convolutions with slightly sloping walls to better provide a geometrically uniform overlapped pattern in the flattened edge portion thereof.

6 Claims, 8 Drawing Figures

METHOD OF MANUFACTURING A HEAT EXCHANGER STEEL

BACKGROUND OF INVENTION

In the manufacturing of corrugated sheet material for stacked plate heat exchangers of the type disclosed in U.S. Pat. No. 3,759,323 issued on Sept. 18, 1973 to H. J. Dawson, et al, and assigned to the assignee of the present invention, problems have been experienced in obtaining deeply drawn corrugations and high quality transition zones intermediate the centrally disposed corrugations and the marginal flat portions of the sheets. This is largely due to the fact that the total surface area provided by the sides or walls of the grooves of the corrugations determines the heat exchanger's capacity and effectiveness, and to meet this requirement and to simultaneously limit the total number of required sheets both the corrugation height and the number of corrugations per unit width have been substantially increased. Consequently, during formation of the corrugations from flat sheet material, the sheets tear because the ductility limits of the material have been exceeded.

More specifically, when high temperature corrosion and heat resistant alloy metal sheets of from 2 to 8 mils thickness are formed into the aforementioned corrugate heat exchanger sheets by striking them in dies the corrugation height is limited to less than about 1 mm (0.039). When corrugated heat transfer heights greater than this are stamped, sheet splitting occurs as a result of exceeding the maximum allowable ductility limit of the alloy. Of course, multiple and progressive die stamping stages are possible with heat treatment between the stages in order to relieve the stresses generated during each stamping operation, but this would be a very costly process.

SUMMARY AND OBJECTS OF THE INVENTION

Accordingly, an object of the invention is to overcome the aforementioned problems by providing an improved method of forming a relatively thin and deformable sheet of metal into a deeply corrugate heat exchanger sheet with relatively flat juxtaposed surfaces.

Another object of the invention is provide a method of manufacturing such a heat exchanger sheet which is better able to form the deep corrugations and flat surfaces thereof while minimizing cold forming and eliminating tearing of the material at the transition zones therebetween.

Another object is to provide an improved method of the character described which is both simple and economical.

Other objects and advantages of the present invention will become more readily apparent upon reference to the accompanying drawings and the following description.

DESCRIPTION OF THE PREFERRED EMBODIMENT

Figure 1:
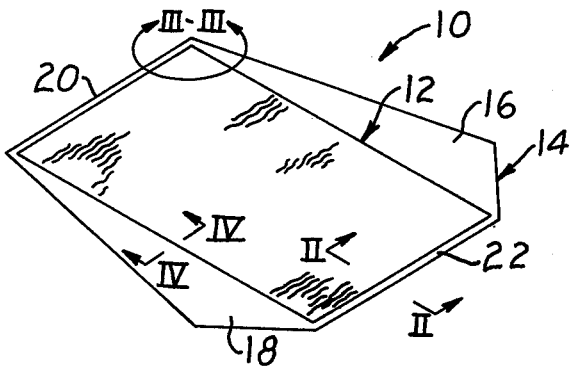
FIG. 1 is a three-dimensional view of a heat exchanger sheet which has been manufactured in accordance with the method of the present invention.

Referring initially to FIG. 1, a formed heat exchanger sheet 10 constructed in accordance with the present invention includes a centrally disposed quadrilaterally-shaped corrugated portion or counterflow area 12 and a flattened peripheral edge portion 14. More particularly, the flattened edge portion includes a pair of outer triangularly-shaped end zones or crossflow zones 16 and 18 flanking the opposite ends of the counterflow area, and a pair of side margins or edges 20 and 22 flanking its opposite sides. Utilizing this construction, and by vertically alignably stacking a plurality of these sheets together in non-nesting relation, a primary surface heat exchanger can be made of the type shown in U.S. Pat. No. 3,759,323 and mentioned above. In such heat exchanger construction the side margins are suitably sealed so that a path is provided for one fluid between certain pairs of adjacent sheets, while alternatingly providing a separate path for another fluid to be heated between such pairs.

Figure 2:
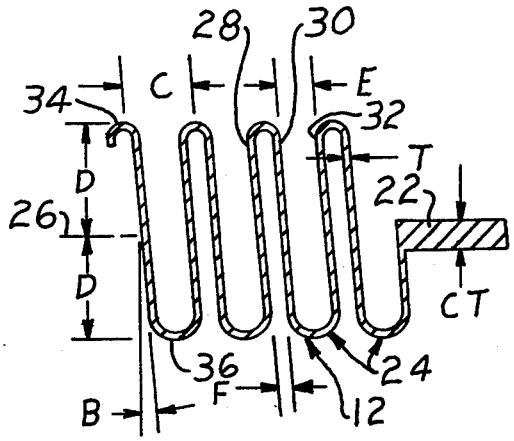
FIG. 2 is an enlarged, fragmentary, and diagrammatic transverse section of the heat exchanger sheet of FIG. 1 taken along the line II—II thereof, and illustrating details of the profile of the corrugations and juxtaposed flattened edge portion thereof.

Each of the sheets 10 is formed from a relatively thin corrosion and heat resistant alloy metal having maximum ductility and formability properties. Preferably, the sheets are formed from solution-annealed stainless steel of from two to eight mils in thickness. As shown in FIG. 2, the thickness (T) of the illustrated embodiment is 0.076 mm (0.003 inch). This sectional view clearly shows that the corrugated portion 12 includes a plurality of vertically extended and repetitive transverse convolutions 24 disposed at a substantially right angle to the general direction of fluid flow and which extend longitudinally between the cross-flow zones 16 and 18 of FIG. 1.

Each of the transverse convolutions 24 extends upwardly and depends downwardly a similar and relatively large distance (D) from a central plane 26 of the sheet 10. This provides a greatly extended and uniform sheet height when compared with the thin sheet thickness, and in the embodiment illustrated, the overall sheet height (2D) is approximately 3.9 mm (0.155 inch). Moreover, each transverse convolution has a sinuous wave profile providing a cycle width (C) of approximately 1.27 mm (0.050 inch). It is to be noted that the major portion of each transverse convolution is so arranged as to provide a plurality of substantially vertically extending, but advantageously slightly leaning walls as indicated generally by the reference numerals 28, 30 and 32. In turn, these walls are joined by a corresponding plurality of upper and lower semicylindrical walls or crest members are respectively indicated by the numerals 34 and 36. However, the vertically extending walls are advantageously unequally laterally spaced and smoothly blended with the crest members to produce a transversely unsymmetrical sinuous wave pattern. For example, the distance (E) between the walls 30 and 32 is approximately 0.83 mm (0.032 inch) and the distance (F) between the walls 28 and 30 is in contrast only approximately 0.30 mm (0.012 inch). This unsymmetrical wave pattern advantageously allows the transverse cross sectional area between the one pair of sheets for one fluid to be established at a predetermined ratio with respect to the area between another pair of sheets for the second fluid. As a result, the effectiveness of the heat exchanger is markedly improved.

Figure 3:
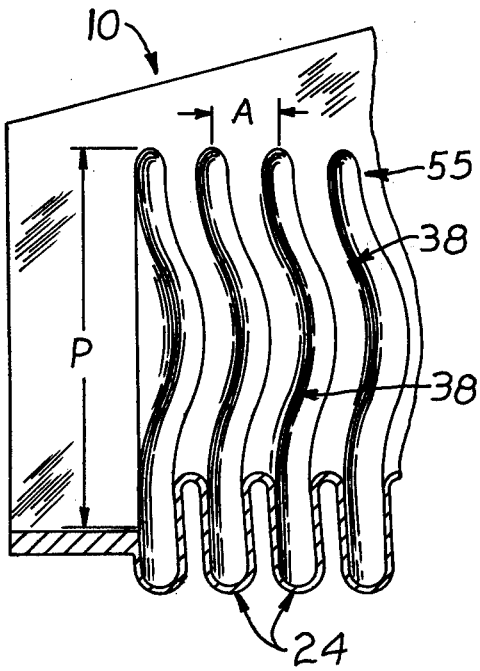
FIG. 3 is an enlarged, fragmentary, and diagrammatic plan view of the heat exchanger sheet of FIG. 1 as taken within the circle identified as III—III in the corner thereof.

With reference now to FIG. 3, each of the sheets 10 is also sinuously profiled in the general direction of fluid flow in order to increase the stiffness of an individual sheet, to improve the overall effectiveness of the heat exchanger, and to permit criss-crossed stacking of the corrugations of adjacent sheets. For example, each of the transverse convolutions 24 includes a repetitive longitudinal convolution or sine wave 38 with a wave pitch (P) of approximately 9.65 mm (0.38 inch), and a wave amplitude (A) of approximately 1.57 mm (0.062 inch). Each of the alternating sheets in the stack is substantially identical to the aforementioned interleaved sheets, but for the fact that their longitudinal waves are arranged symmetrically out of phase or longitudinally offset with respect to the sheets juxtaposed thereto. Such predetermined misalignment and wave pattern relationship of the interleaved sheets is discussed in greater detail in application Ser. No. 595,969 filed on July 14, 1975 by H. J. Dawson, et al., and assigned to the assignee of the present invention.

Figure 5:
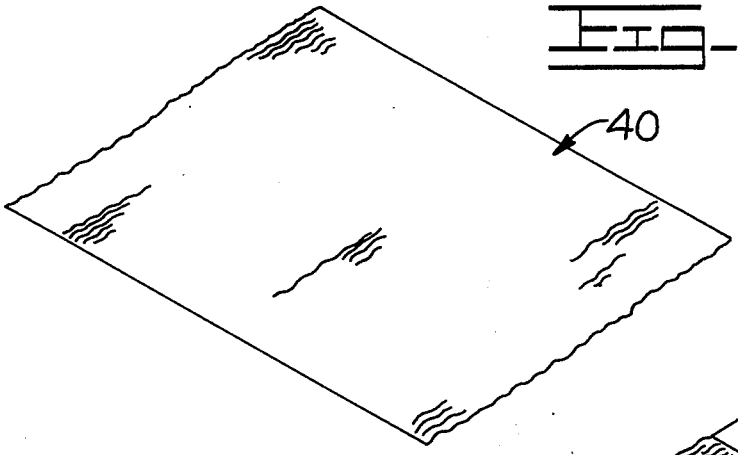
FIG. 5 is a fragmentary three-dimensional view of a continuously corrugated sheet which is utilized during an initial phase of the manufacture of the heat exchanger sheet of FIG. 1 in accordance with the method of the present invention.

In accordance with the present invention, however, the sheet 10 is manufactured in the following manner. Initially, an elongated flat sheet of stainless steel or the like is fed into a sheet material forming apparatus, not shown, of the type disclosed in U.S. Pat. No. 3,892,119 issued July 1, 1975 to K. J. Miller, et al., and assigned to the assignee of the present invention. Such apparatus foldably forms the flat sheet into a continuously corrugated sheet 40 as shown in FIG. 5 by individually manufacturing the aforementioned transverse convolutions 24 fully across the sheet in a progressively sequential manner to minimize stretching and to eliminate tearing of the material. It has been found that only by utilizing the folding or pleating action of the opposed sets of forming members in the referenced sheet material forming apparatus can the transverse convolutions and the associated longitudinal convolutions 38 be so deeply formed without excessive cold work hardening of the stainless steel. In addition, such folding action imparts certain desirable sloping qualities to the walls 28, 30 and 32 of the corrugations. As indicated by the angle identified by the letter B in FIG. 2, the walls are sloped or inclined relative to the central plane 26 at an angle of from 3° to 15°, and preferably at an angle of approximately 9°. These sloping qualities would be totally absent if these corrugations were formed by die press forming, for example.

Figure 4:
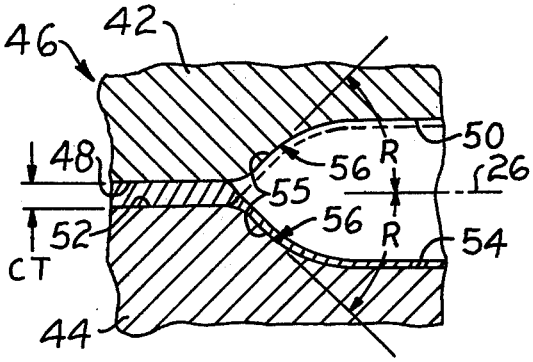
FIG. 4 is an enlarged, fragmentary, and diagrammatic longitudinal section of the heat exchanger sheet of FIG. 1 taken along the line IV—IV thereof, and adding thereto for illustrative purposes the pair of opposed dies which are utilized in the manufacturing thereof and which contribute to the successful profile of the transition zones at the ends of the corrugations.

The continuously corrugated sheet 40 is then placed between a pair of specifically contoured dies 42 and 44 of a conventional crushing apparatus or die press 46, only a portion of which is shown in FIG. 4 for illustrative convenience. The upper die 42 has a relatively flat and downwardly facing peripheral surface 48 and a centrally disposed and recessed surface 50 parallel thereto, and the lower die 44 is a mirror image thereof with an upwardly facing peripheral surface 52 and a centrally disposed recessed surface 54. While the dies have side walls, not shown, which border the opposite sides of the recesses and are normal to both surfaces thereof, in accordance with one aspect of the present invention each of the dies has a tailored ramp or smoothly tapering end surface as generally indicated by the reference numeral 56 intermediate the recess surface and the peripheral surface at each end thereof.

Thus, it may be appreciated that the peripheral surfaces 48 and 52 of the upper and lower dies 42 and 44, respectively, make the initial closing contact against the continuously corrugated sheet 40. Thereafter as additional compressive loading is applied, the dies effectively approach one another until a predetermined crushed thickness (CT) of approximately 0.68 mm (0.027 inch) is achieved at the peripheral edge portion 14 of each of the sheets 10. In the instant embodiment, for example, a relatively high compressive loading of over 2,110 kg per sq. cm (30,000 psi) is applied to the peripheral edge portion to compress it to a substantially flattened condition with minimal cold working or flow of the metal. Simultaneously therewith the ramps 56 of the dies apply a predetermined and progressively reduced loading upon the corrugated sheet down to a minimal loading of the opposed recessed surfaces 50 and 54. This advantageously forms a pair of outwardly converging tapered transition zones 55 on the sheet which are symmetrical with respect to the central plane 26. At the time of maximum compression, the distance or elevation between these recessed, surfaces is approximately equal to the overall height (2D) of the corrugated portion 12 thereof so that its original profile remains substantially unchanged.

Figure 7:
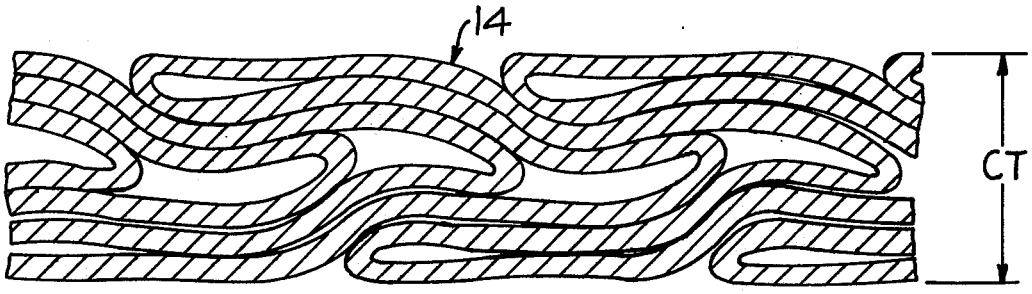
FIG. 7 is a diagrammatic and representative transverse sectional view at a magnification of approximately 50 times of the deeply drawn corrugations of the heat exchanger sheet of FIG. 1 after they have been uniformly flattened in accordance with the present invention.

More specifically, and in accordance with one aspect of the invention, the flattened peripheral edge portion 14 of the sheet 10 is relatively uniform in the manner in which the deeply drawn convolutions 24 and 38 are overlappingly collapsed. To better appreciate this, reference is made to FIG. 7 showing a greatly enlarged transverse sectional view of the geometric pattern of the collapsed corrugations. Although flattening of the convolutions of the instant example results in predictably obtaining from 5 to 7 layers of sheet thickness at any one point, the overall thickness (CT) can be controlled to a predetermined range of dimensions including taking into account a natural separating tendency between the walls due to the inherent spring-back action of the stainless steel material. Furthermore, as FIG. 7 clearly indicates, the geometric pattern of the flattened convolutions is desirably very repetitious and this is in part due to the fact that the walls 28, 30 and 32 of the corrugations are slightly sloped as shown in FIG. 2. Consequently, when the dies come together there is already a built-in tendency for the convolutions to lay down in predetermined directions.

In connection with the profile of the die ramps 56, it has been found that the ramp angle R illustrated in FIG. 4 should neither be too abrupt nor too extended in order to form the best tapered transition zones 55. If the inclination of the ramps is too steep, excessive deformation of the ends of the longitudinal convolutions 38 occurs, along with the greatly increased tendency of the sheet material to tear. On the other hand, if the ramps are made too long, deformation is also excessive and the adjacent sheets in the heat exchanger stack have a much longer unsupported relationship between them in the transition zone which decreases heat exchanger rigidity. It should be appreciated that the excessive deformation which occurs with ramp angles of either extreme leads to fluid flow blockage and pressure drop problems in the heat exchanger. In the instant embodiment, a range of ramp angles of from 20° to 60° has been found satisfactory, with the preferred angle being approximately 45°.

Figure 6:
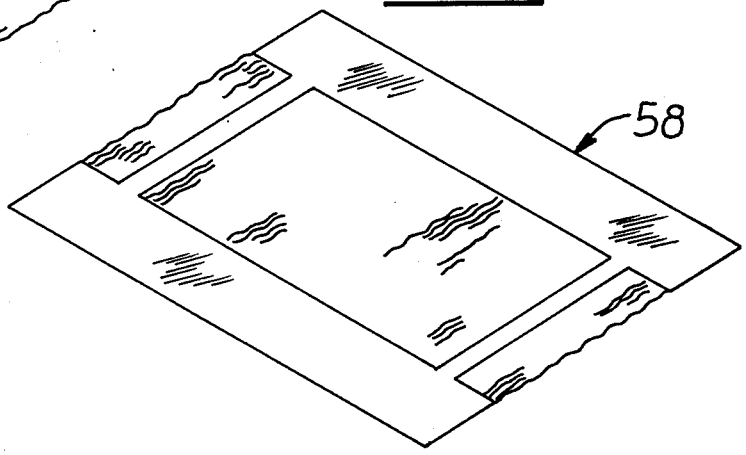
FIG. 6 is a fragmentary three-dimensional view of the corrugated sheet of FIG. 5 after it has been peripherally flattened in accordance with a subsequent step of the method of the present invention.

After the continuously corrugated sheet 40 is compressed in the die press 46, it may be reoriented therein to allow an adjacent section to be similarly flattened in accordance with typical assembly line procedures. A portion of the profiled and flattened sheet which is removed therefrom is indicated generally by the reference numeral 58 in FIG. 6. Then the flattened sheet 58 is trimmed to the desired final dimensions as is clearly apparent with reference to FIG. 1.

It is to be appreciated that if a lessor deeply drawn convolution configuration is crushed, the transverse sectional geometric pattern thereof and the crushed thickness (CT) will change. For example, in an alternate embodiment, having generally the same physical characteristics as FIG. 2, only with an overall convolution height (2D) of 2.36 mm (0.093 inch), a crushed thickness of approximately 0.3 mm (0.12 inch) was realized. As is clearly shown in FIG. 8 this alternate embodiment heat exchanger sheet 60 has been peripherally compressed to a more favorable degree of flatness since only three to five layers of sheet material are uniformly overlapped at any one point.

It is therefore apparent that the heat exchanger sheet 10 which has been manufactured in accordance with the present invention is relatively economical to produce, and yet it has certain desirable physical characteristics. Particularly, the flattened peripheral edge portion 14 thereof is strong or stiff by virtue of the fact that at least three thickness of sheet material are overlapped thereat as is best visualized by making reference to FIGS. 7 and 8. This stiffness provides additional rigidity to the heat exchanger. Furthermore, each of the sheets thus formed has an excellent service life in the deleterious environment of a heat exchanger because cold forming of the metal has been minimized, and the transition zones favorably taper convergingly from the corrugated area 12 to better blend with the flattened peripheral edge portion 14.

Figure 8:
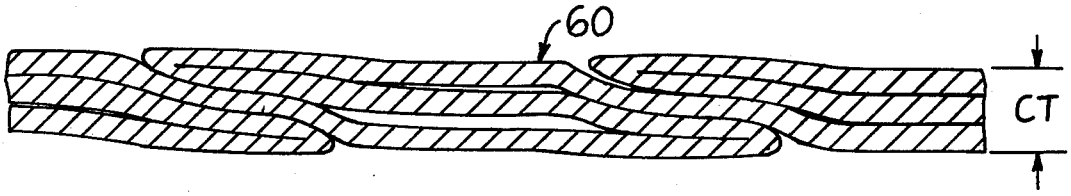
FIG. 8 is a diagrammatic and representative transverse sectional view at a magnification of approximately 50 times of a flattened portion of a heat exchanger sheet similar to FIG. 7, only showing the geometrically uniform overlapped nature of an alternate embodiment corrugation profile of proportionately less overall height.

It is also to be appreciated that while the greatly enlarged sectional views of FIGS. 7 and 8 appear very uneven at the upper and lower surfaces thereof, in actual size these surfaces are considered as being substantially flat. Moreover, the crushed thickness (CT) thereof generally represents a height of from 10% to 20% of the overall convolution height (2D). This provides the desirable degree of cross-sectional flow path area between the sheets in the cross flow zones 16 and 18 with a commensurately low pressure drop thereat.

While the invention has been described and shown with particular reference to a preferred embodiment, it will be apparent that variations might be possible that would fall within the scope of the present invention, which is not intended to be limited except as defined in the following claims.

We claim:

1. A method of manufacturing a heat exchanger sheet comprising;

foldably forming an elongated flat sheet of material into a continuously corrugated sheet by feeding the flat sheet progressively through a forming apparatus, the corrugated sheet being formed with a plurality of deep transverse convolutions which extend across said sheet and with each transverse convolution extending longitudinally in a repetitive pattern; and compressing the periphery of said corrugated sheet to provide a substantially flattened edge portion with a fully overlapping geometrically repetitive collapsed pattern of at least three thicknesses of sheet material while retaining a centrally disposed corrugated portion with minimal cold working thereof.

2. The method of claim wherein said convolutions extend upwardly and depend downwardly a substantially similar distance from a central plane thereof and including the step of compressing the periphery of said corrugated sheet in a die press so constructed and arranged as to position said flattened edge portion on said central plane.

3. The method of claim 2 including the step of utilizing a pair of dies in said die press having ramp means therein for forming tapered transition zones at the opposite ends of said corrugated portion.

4. A method of manufacturing a heat exchanger sheet comprising;

progressively foldably forming an elongated flat sheet of metal into a continuously corrugated sheet having a plurality of transversely oriented and sinuously profiled convolutions which extend fully across said sheet and with each transverse convolution extending longitudinally in a repetitive pattern; and compressing the periphery of said corrugated sheet in a die press so constructed as to provide a substantially flattened edge portion on a central plane of said corrugated sheet with a fully overlapping repetitive pattern of at least three thicknesses of sheet material while retaining a centrally disposed quadrilaterally-shaped corrugated portion with minimal cold working thereof.

5. The method of claim 4 including the step of using a pair of dies in said die press which have ramp means thereon for forming a pair of tapered transisiton zones at each opposite end of said corrugated portion.

6. The method of claim 5 wherein said tapered transition zones are tapered convergingly outwardly in a symmetrical manner with respect to said central plane.

* * * * *